United States Patent [19]

Ettlinger et al.

[11] Patent Number: 4,607,795

[45] **Date of Patent: * Aug. 26, 1986**

[54] SPRAY HEAD ASSEMBLY

[75] Inventors: Ralph Ettlinger, Glencoe; John A. Biela, Niles, both of Ill.

[73] Assignee: Amco Corporation, Chicago, Ill.

[ * ] Notice: The portion of the term of this patent subsequent to Jul. 9, 2002 has been disclaimed.

[21] Appl. No.: 661,180

[22] Filed: Oct. 15, 1984

Related U.S. Application Data

[63] Continuation-in-part of Ser. No. 533,606, Sep. 19, 1983, Pat. No. 4,527,743.

[51] Int. Cl.[4] ..... B05B 9/00

[52] U.S. Cl. ..... 239/530; 239/562; 239/586; 239/588; 251/147; 251/238

[58] Field of Search ..... 239/530, 562, 588, 586; 251/147, 193, 176, 238, 243, 279

[56] References Cited

U.S. PATENT DOCUMENTS

| | | | |
|---|---|---|---|
| 691,651 | 1/1902 | Morrill | 239/530 |
| 990,179 | 4/1911 | Wilson et al. | 239/586 |
| 2,556,225 | 6/1951 | Serge | 251/193 |
| 2,668,083 | 2/1954 | Kirchner | 239/530 |
| 3,022,015 | 2/1962 | Burch | 239/530 |
| 3,131,868 | 5/1964 | Coleman | 239/562 |
| 3,183,926 | 5/1965 | Boudot | 251/193 |
| 3,214,133 | 10/1965 | Rodgers et al. | 239/562 |
| 3,310,326 | 3/1967 | Melone | 277/212 FB |
| 3,559,947 | 2/1971 | Sette | 251/147 |
| 3,575,377 | 4/1971 | Carlton et al. | 251/176 |
| 3,637,143 | 1/1972 | Shames et al. | 239/530 |
| 3,776,276 | 12/1973 | Stiltner | 251/193 |
| 4,248,815 | 2/1981 | Blackburn et al. | 251/193 |

*Primary Examiner*—Joseph F. Peters, Jr.
*Assistant Examiner*—Michael J. Forman
*Attorney, Agent, or Firm*—Laff, Whitesel, Conte & Saret

[57] ABSTRACT

A spray head assembly is made from a very few number of injection molded parts. Preferably a pair of elongated housing shells fit together in face-to-face confrontation, with a spring biased actuator arm or control lever pivotally mounted between them. The lever has a metal shaft extending therefrom, which passes through a flexible cone in a rubber bulkhead to maintain a waterproof seal. In front of the bulkhead is a solid plastic plate having mounted therein a reciprocally slidable member controlled by the lever. In one embodiment, the sliding member contains a generally triangular or tapered opening or openings having a sector of a circle for a base. Depending upon the position of the slide, the opening moves up or down to open or close a water passageway through the spray head. The sliding member first presents the smaller sectors of the opening or openings to an associated sealing ring to minimize the abruptness of any change in discontinuity of water flow at the edge of the opening. In another embodiment, a stainless steel plate is countersunk in or affixed to the back of the sliding member to reduce wear. The spray head delivers water in a generally rectangular spray pattern.

14 Claims, 9 Drawing Figures

70
71
73
72
44
D
C
80
84
78
61
66
67
62
82
60
64
68
69

80
84a
85
87
78
61
62
82
60
64

85a
87a 40
58
56
105
97
98
28
101
103
109
107
30

82
60
67
66
69
68

86
67
66
90
92
44
94
68
69
88
96

SPRAY HEAD ASSEMBLY

This is a continuation-in-part of U.S. application Ser. No. 533,606, filed Sept. 19, 1983, now U.S. Pat. No. 4,527,743, granted July 9, 1985.

This invention relates to spray head assemblies, and more particularly, to spray heads for use on or in connection with dishwashing installations.

Spray heads associated with sinks, dishwashing and the like generally have a circular or round spray pattern. Usually, they include metal parts, chrome plating and a complex mechanical construction. Very often, as many as twenty parts may be used in such a spray head assembly. Due to its complexity, this construction often requires frequent replacement of parts. Also, the circular spray pattern tends to provide a form of mutually interfering water flow on the sprayed object, by which the dishes are gently bathed. While such a spray may be good for removing loose food, it is not overly efficient for removal of any residue which tends to be stuck to the dish. Another problem which has been encountered relates to a use in spray heads of metal parts which, unlike plastic, attract mineral deposits, corrosive forces, and the like. The metal is both heavier and more expensive than comparable plastic would be and because it is in direct contact with the hot water, becomes uncomfortably hot to handle.

For any of many purposes, such as threaded fasteners or special surface characteristics, it may be desirable to have a few metal parts. However, if a design is such that the use of metal is minimized, a high quality metal, such as stainless steel, may be used in very small parts without running up costs appreciably. That quality of metal resists corrosion, a build-up of mineral deposits, and the like.

Accordingly, an object of the invention is to provide new and improved spray heads. Here, an object is to provide a lightweight, low cost, mechanically dependable spray head with a superior water distribution pattern. In this connection, an object is to provide a sharp spray which tends to have a knife-like cutting quality.

Another object of the invention is to provide a more durable, simpler, non-corrosive spray head. Here, an object is to provide a spray head made almost entirely of injection molded plastic. In this connection, an object is to minimize the use of metal to such an extent that, when required, it may be made of a very high quality material.

Still, another object is to provide an easy to use spray head which may be easily grasped in a number of different ways. Here, an object is to provide a more foolproof system which makes it easier to operate the spray head in a proper manner.

A further object is to provide a spray head that does not become uncomfortably hot to handle during use.

In keeping with an aspect of the invention, a spray head is made primarily from injection molded plastic parts. A pair of housing shells fit together in a face-to-face confrontation. Pivotally mounted between the housing shells is a spring biased lever or actuator arm, which has a metal shaft extending therefrom. The shaft passes through a flexible cone integrally formed as a part of a rubber bulkhead, which enables the lever to see-saw while maintaining a waterproof seal within a spray head compartment. In a preferred embodiment, the front of the bulkhead is a solid plastic plate having a reciprocally sliding member with a combination of a stainless steel plate moving over a polytetrafluoroethylene ("TFE") insert bushing. The sliding of the plate is controlled by the see-sawing of the lever. The sliding stainless steel plate contains at least one opening to open and close a water flow path without snagging on or abraiding or deforming the "TFE" bushing or other seal members. Depending upon the position of the slide, water is delivered from the spray head in a generally rectangular pattern of water flow.

A preferred embodiment of the inventive spray head is seen in the attached drawings, wherein.

Figure 1:
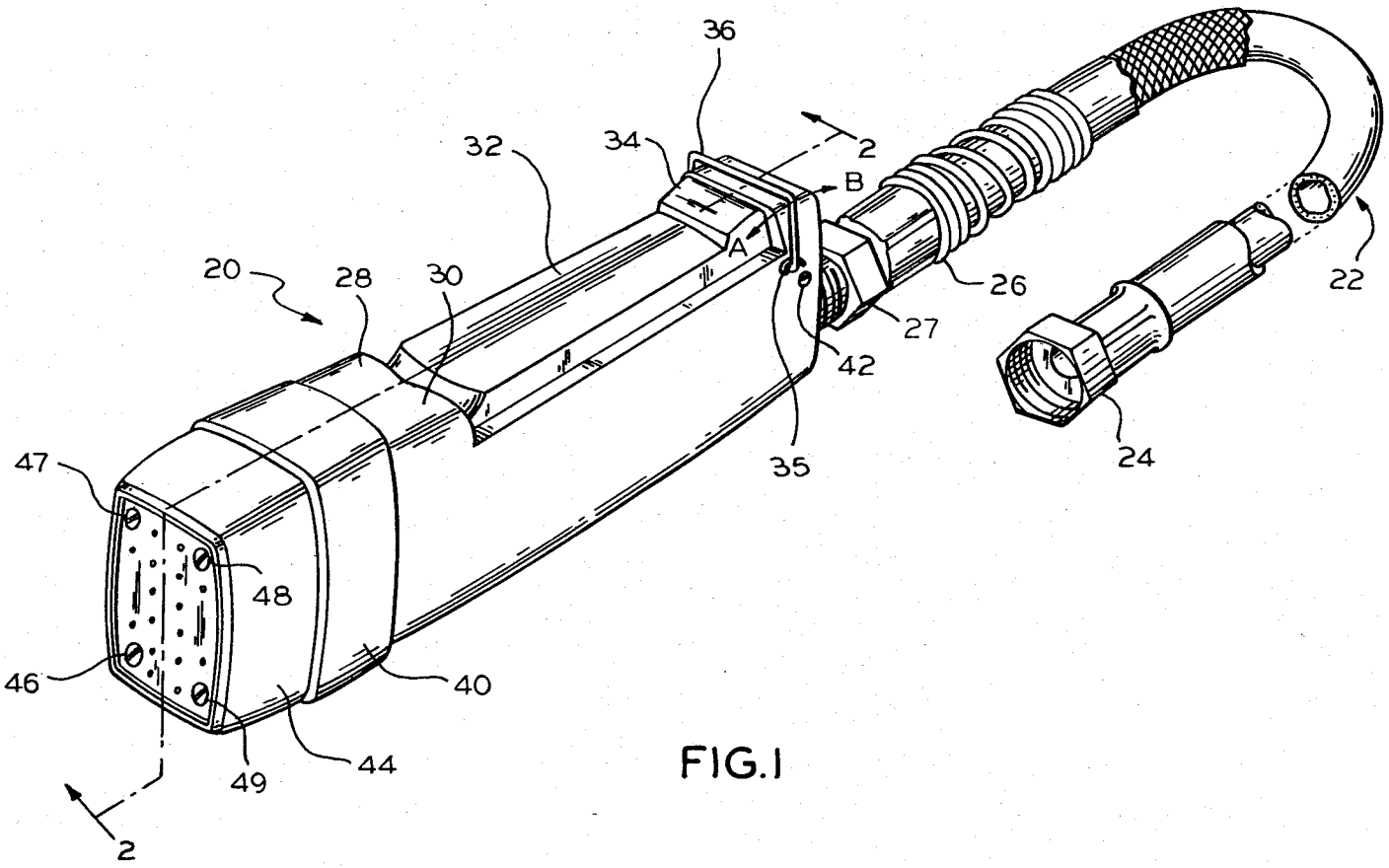
FIG. 1 is a perspective view of the inventive spray head with an attached water hose.

The spray head 20 is here shown as being connected to a hose 22, leading to a fitting 24 which may be connected to any suitable water pipe or faucet. A spring 26 surrounds the region adjacent a fitting 27 where the hose joins the spray head in order to give it mechanical strength and stress relief without a loss of flexibility. A similar spring may be attached to the other end of the hose adjacent the connection to the water pipe or faucet. To facilitate the use of the spray head, a suitable swivel may be incorporated in the hose or end fittings.

In the preferred embodiment, the spray head 20 has two elongated housing shells 28, 30 with a spring biased lever or actuator arm 32 pivotally mounted between them. The actuator arm 32 has an upstanding boss 34 formed on an end remote from the pivot to act as a keeper for a U-shaped, round or flat wire spring locking member 36. The ends of member 36 snap into opposing holes in the housing shells 28, 30 so that it may swing in directions A, B. The locking member 36 is shown in FIG. 1 at the end of its excursion in direction B where it is out of the way and has no effect. Suitable detents 35 disposed on the sides of shells 28, 30 hold the keeper at the ends of its excursion in direction B. When the arm 32 is depressed and locking member 36 is swung in direction A, it fits over and hooks against the keeper 34 to hold the actuator arm 32 in an operating position.

The housing shells are indexed into proper position by pegs (not shown) which fit into holes 59. The front ends of the housing shells 28, 30 fit into a rubber bulkhead 40 which surrounds them and assists in holding them in place. The sides of the housing shells are secured in place by three screws which are threaded into bosses 42. A spray head plate 44 is attached through the bulkhead to the housing shells 40 by four screws 46, 47, 48 and 49.

Air space 31 (FIG. 2) formed in housing shells 28, 30 helps to insulate spray head 20 so that the hot water flowing through the pipe 98 does not overheat shells 28, 30 and make it uncomfortable to handle the device.

In operation, the hose fitting 24 (FIG. 1) is attached to any suitable pressurized water supply. A person holds the spray head 20 and moves the arm 32 downwardly (as viewed in FIG. 1) to cause water to issue from spray head plate 44. When released, the arm 32 moves up under a spring bias to stop the spray.

Figure 2:
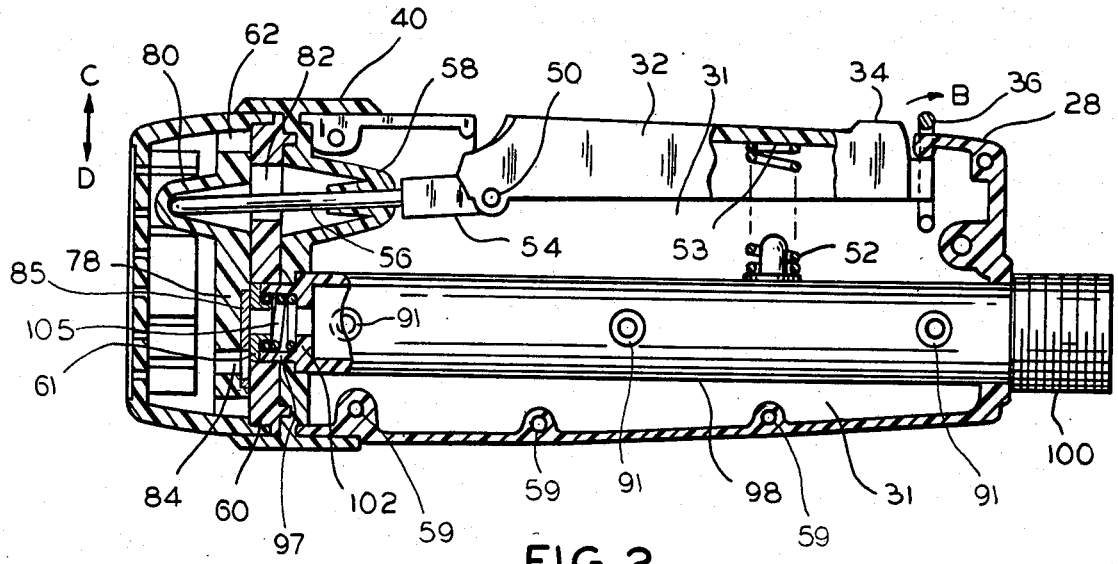
FIG. 2 is a cross section taken along line 2—2 of FIG. 1, showing the valve in a closed position.
Figure 3:
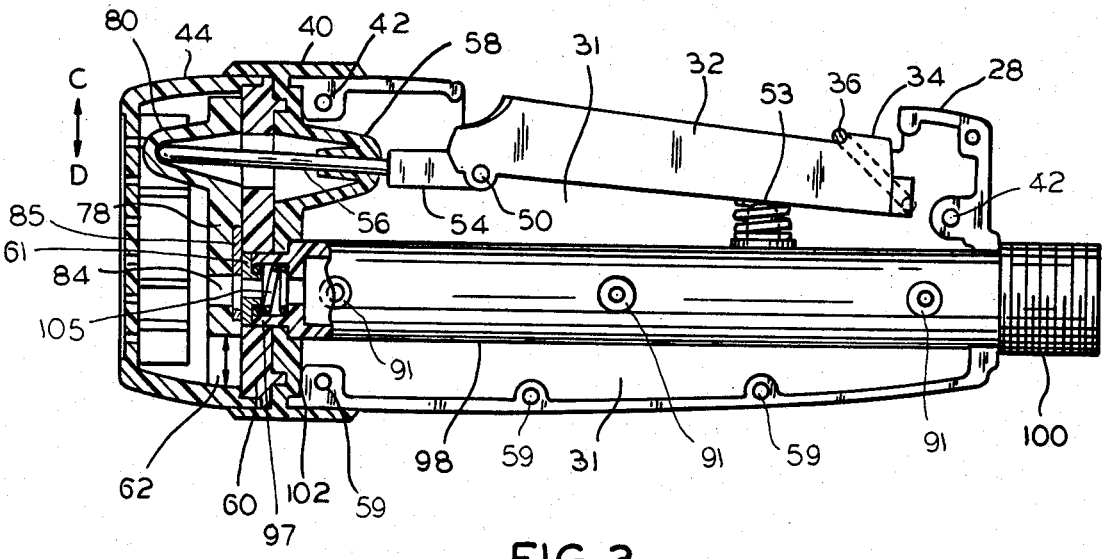
FIG. 3 is a similar cross section showing the valve in an opened position, with a locking member in place to hold the valve open.
Figures 4, 4A, 4B, 5, 6, 7:
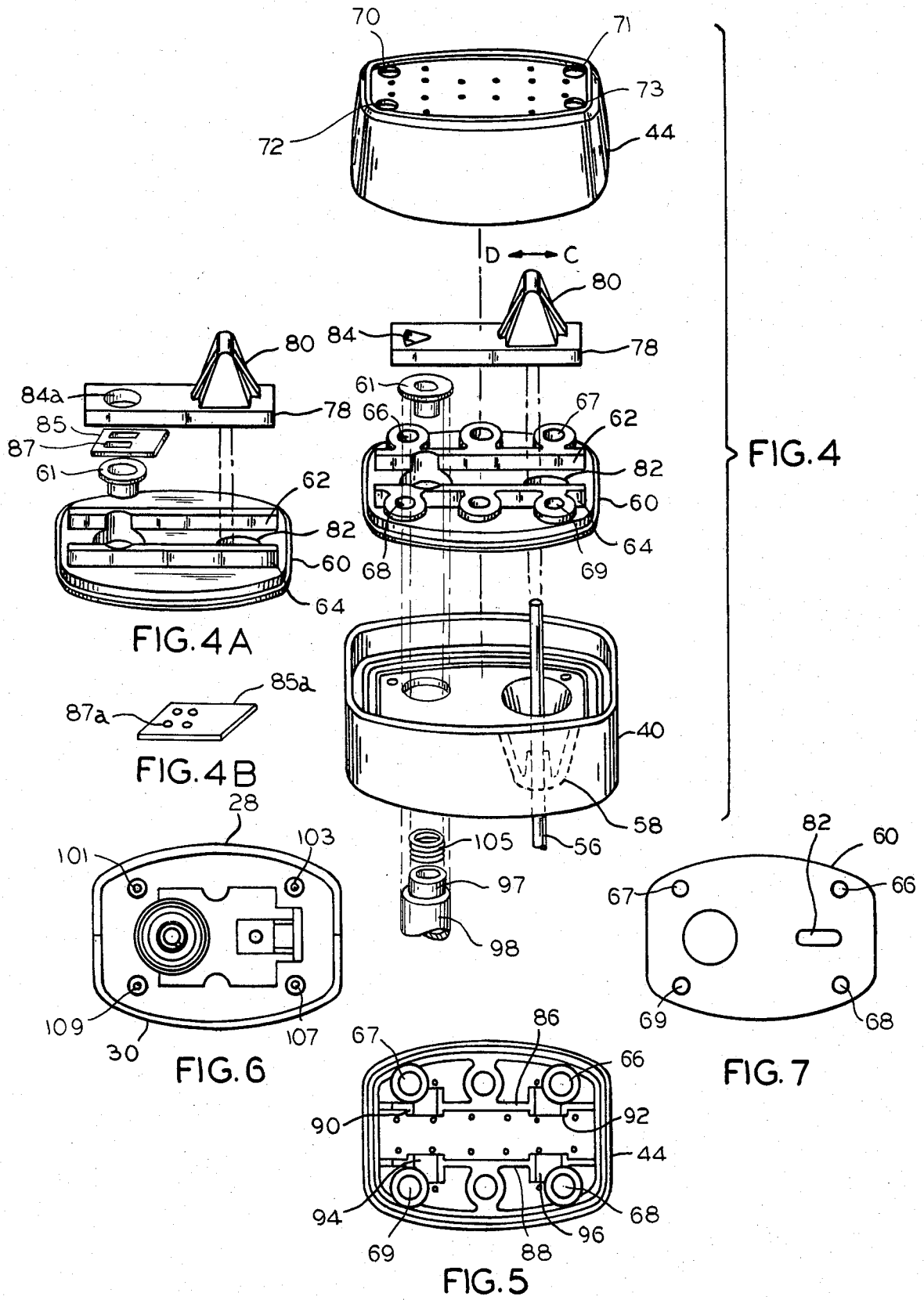
FIG. 4 is an exploded view of the head portion of the spray head assembly.
FIG. 4A is a part of FIG. 4 showing a metal plate and plastic bushing used to increase the smoothness of the sliding valve action and to reduce wear.
FIG. 4B is a perspective view of a second embodiment of the metal plate.
FIG. 5 is a back view of the perforated spray plate showing members for distributing water to the outlet holes in the spray head.
FIG. 6 is a front view of the housing shells fitted together.
FIG. 7 is a back view of the valve support plate.

FIGS. 2 and 3 show the construction inside the housing of the embodiment of FIG. 4A, the valve being closed in FIG. 2 and open in FIG. 3. The actuator arm 32 is pivotally attached to the housing at 50, by two pins which are integrally molded on the actuator arm to fit into recesses formed inside the housing shells. A coiled spring 52 is positioned under the distal end of the actuator arm 32, to bias it to an elevated or unoperated position. A boss 53 is formed on the inside surface of arm 32 to hold spring 52 in place.

The front end of actuator arm 32 terminates in a socket 54, integrally molded therein. A metal rod 56 is inserted into the socket 54, to move as a unit with the arm 32. The arm 32 and rod 56 see-saw about the pivot 50 under either the hand applied pressure of an operator pushing on arm 32 or the return force of spring 52.

Rod 56 projects through a hole and sleeve in conical bushing 58 which is an integral part of the rubber bulkhead 40. The bulkhead 40 surrounds the ends of housing shells 28, 30 and spray head plate 44 to keep the water in the spray head end and out of the control end of the housing. The elasticity of the conical bushing 40 enables the rod 56 to move up or down without interfering with the bulkhead seal.

FIG. 4 is an exploded view of the end of the spray head assembly. A rigid valve support plate 60 has a pair of spaced parallel upstanding guide ways 62, 64 formed therein, along with holes 66, 67, 68 and 69 for receiving spray head plate mounting screws 46, 47, 48 and 49 (FIG. 1). The screws pass through holes 70, 71, 72 and 73 in plate 44, and through bosses embodying holes 66, 67, 68 and 69 in plate 60 which fit inside corresponding and unnumbered holes in bulkhead 40 and thread into holes 101, 103, 107 and 109 (FIG. 6) in shells 28 and 30.

A sliding valve plate 78 rides between the upstanding guide ways 62, 64. The valve plate 78 has a socket 80 for receiving an outer end of rod 56, which passes through a slot 82 in plate 60, as well as the conical portion 58 of rubber bulkhead 40. When the outer end of rod 56 moves in direction C, plate 78 slides in direction C and when rod 56 moves in direction D, plate 78 slides in direction D.

In one embodiment (FIG. 4), a hole 84 is formed in sliding valve plate 78 to open or close a passageway for water to flow through. This hole 84 is tapered in shape, preferably somewhat triangular, with an apex on the end which is closest to the water passageway and an arcuate base on the other end. The side of the hole 84 that is next to the valve support plate 60 is preferably counter sunk or recessed and rounded so that no edges with sharp corners snag, catch or otherwise impinge on a confronting wear resistant bushing 61 as the valve plate 78 slides over bushing 61 and end seal 97 (FIGS. 2, 3). The wear-resistant bushing 61 made of a material with a low coefficient of friction such as "TFE" fits over and inside the seal end of 97 of pipe 98. Bushing 61 is adjacent valve plate 78 to act as an interface between the seal end 97 and the valve plate 78. Bushing 61 ensures that the valve plate smoothly slides over end 97 without catching or producing unnecessary wear on the seal.

In a second embodiment (FIG. 4A), a stainless steel plate 85 is embedded in the bottom of slide 78 to interface with the "TFE" bushing 61 and to resist wear and friction by interfacing different materials (metal to plastic). Since the bushing 61 and steel plate 85 provide a smoother sliding surface, the hole 84*a* does not have the triangular shape that is seen at 84 in FIG. 4. In FIG. 4A, the water passageway is through two elongated slots 87 formed in steel plate 85. As shown in FIG. 4B, the stainless steel plate 85A has four circular holes 87A which form a water passageway.

The inside of the spray head plate 44 contains divider walls 86, 88 (FIG. 5) which bear against the sliding valve plate 78 to hold it firmly in place against plate 60 and "TFE" bushing 61 and between guide walls 62, 64. The water completely fills the spray head plate 44 when valve hole 84 on sliding valve plate 78 is in the water flow position.

A pipe 98 (FIGS. 2, 3) extends from a threaded end 100 which receives a fitting 27 (FIG. 1) to an opposite end seal 97 that holds bushing 61. The hose fitting 27 (FIG. 1) makes a connection with the threaded end 100. The end seal 97, together with bushing 61, fits tightly behind and abuts against the sliding valve plate 78 to prevent water from leaking behind the sliding valve plate 78. This end seal 97 is a reduced diameter on pipe 98 into which may be inserted a bias spring 106 which urges bushing 61 against sliding valve plate 78 to ensure that seal 97 and bushing 61 remain in contact with plate 78. The apex of triangular opening 84 (embodiment of FIG. 4) slides first over the bushing 61 to minimize the abruptness of any change in discontinuity in water flow. The rectangular openings 87 or holes 87A perform a similar function with respect to the embodiments of FIGS. 4A, 4B. Pipe 98 is held in place by pegs 91 which fit into matching holes in body shells 28 and 30.

If desired, stops may be provided on valve support plate 60 so that when the mounting screws 46, 47, 48 and 49 are tightened, they will not squeeze and distort rubber bulkhead 40 due to uneven pressure applied by the screws. Distortion of the bulkhead 40 may cause support plate 60 and slide valve 78 to sit unevenly with respect to end seal 97, resulting in excessive wear on the seal. Thus, the stops are positioned to help ensure that sliding valve plate 78 sits evenly with respect to bushing 61 and seal 97 to avoid unnecessary wear.

The operation of the spray head should be apparent by an inspection and comparison of FIGS. 2, 3. In FIG. 2, spring 52 biases actuator arm 32 which pivots around point 50 and lowers the end of rod 56 (in direction D). As the rod end moves downwardly, valve plate 78 slides down and the hole 84 passes away from the opening through pipe 98. The bushing 61 remains pressed against the back of the sliding plate 78 (or a solid part of stainless steel plate 85 in FIG. 4A) to keep water from leaking or flowing out of the pipe 98.

When the actuator arm 32 is pushed downwardly against the bias of spring 52 to pivot about point 50, the distal end of rod 56 moves up in direction C. Valve plate 78 slides up and hole 84 (87 in FIG. 4A) moves in front of the bushing 61; however, the dimensions are such that the part of plate 78 surrounding hole 84 presses against bushing 61 which continues to prevent water from leaking out the back of plate 78. Water passes through hole 84 (87 in FIG. 4A) and out the holes in the shower head plate 44. Locking member 36 may be moved in direction A to hold the actuator arm 32 in the operated position.

When the arm is released, spring 52 returns it to the unoperated condition (FIG. 2).

Those who are skilled in the art will readily perceive how to modify the invention. Therefore, the appended claims are to be construed to cover all equivalent structures which fall within the true scope and spirit of the invention.

The invention claimed is:

1. A spray head assembly comprising a housing shell, spring biased actuator lever arm means pivotally mounted in the housing shell, bulkhead means including a flexible cone with a sleeve at the apex of the cone for sealing off an enclosed spray head compartment at the front of said housing, a shaft extending from said lever arm means and passing through said flexible cone and said sleeve in said bulkhead means which enables the actuator lever arm means and said shaft to see-saw about said pivotal mounting while maintaining a waterproof seal within the spray head compartment, valve means coupled to said shaft and positioned in front of the bulkhead, said valve being operated between opened and closed positions by the see-sawing of said actuator lever arm means, a pressurized water passageway being open and closed by said valve means, and means at the output of said spray head for delivering a spray pattern of water flow responsive to an opening of said water passageway.

2. The spray head assembly of claim 1 and a low friction and wear resistant bushing disposed between an end of said pressurized water passageway and said valve means to act as an interface which facilitates sliding.

3. The spray head of claim 1 wherein the back of said valve means includes an elongated metal insert plate positioned in front of said water passageway, one end of said metal plate including a solid part which closes said passageway when said lever arm see-saws to one position and the other end of said metal plate includes at least one water passing hole which opens said passageway when said lever arm see-saws to an opposite position.

4. The spray head of claim 3 wherein said valve means is a sliding part and said metal plate is affixed on said sliding part.

5. The spray head of claim 3 and a wear resistant bushing positioned in the end of said passageway to press against said metal plate.

6. The spray head of claim 5 wherein said metal plate is stainless steel and said wear resistant bushing is "TFE".

7. A spray head assembly comprising an elongated housing, a plate at one end of said housing having spray holes formed therein for giving a generally rectangular spray pattern, movable actuator arm means at the other end of said elongated housing for controlling the flow of water through said spray holes, spring means for normally biasing said movable actuator arm means to a position which shuts off the flow of water, pipe means having a sealing member at one end thereof for conveying water through said housing means to said spray holes, a low friction bushing on the end of said pipe, a sliding valve means positioned in front of said sealing member for sliding over said bushing and opening and closing said pipe means responsive to movement of said actuator arm means, and a blukhead for sealing said housing to said plate containing said pattern of spray holes, said bulkhead including at least a conical flexible section in said bulkhead for transmitting actuator arm movement to said sliding valve means.

8. The spray head of claim 7 wherein said pipe means is a made of non-corrosive plastic, with threads at one end and said sealing member at the other end.

9. The spray head of claim 7 and an elongated metal plate having openings in one end and a solid part in the other end, said plate being affixed on said sliding valve means to place said openings in front of said pipe for opening a valve controlled by said sliding valve means and said solid part in front of said pipe for closing said valve.

10. The spray head assembly of claim 9 and a bulkhead for sealing said housing to a plate containing said spray holes, said bulkhead including a flexible conical part with a sleeve inside said conical part for transmitting actuator arm movement to said sliding valve means.

11. The spray head assembly of claim 10 wherein said bulkhead is made of rubber-like material.

12. The spray head assembly of claim 10 wherein said bulkhead incorporates a hole and sleeve for allowing a shaft extending from said movable actuator arm means to pass through it in a water tight manner.

13. The spray head assembly of claim 7 and an air space disposed within said housing to insulate said housing from said pipe means.

14. A spray head assembly comprising an elongated housing having spray holes formed at one end thereof for giving a generally rectangular spray pattern, movable actuator arm means at the other end of said elongated housing for controlling the flow of water through said spray holes, spring means for normally biasing said movable actuator arm means to a position which shuts off the flow of water, pipe means having a sealing member at one end thereof for conveying water through said housing means to said spray holes, a valve having a sliding means positioned in front of said sealing member for opening and closing said pipe means responsive to movements of said actuator arm means, an elongated metal plate having openings in one end and a solid part in the other end, said plate being affixed on said sliding means to place said openings in front of said pipe for opening said valve means and said solid part in front of said pipe for closing said valve, and a bulkhead made of rubber-like material for sealing said housing to a plate containing said spray holes, said bulkhead including a flexible conical section in said bulkhead for transmitting the movement of said actuator arm means to said sliding means, said bulkhead further incorporating a hole and sleeve for allowing a shaft coupled to said movable actuator arm means to pass through it in a watertight manner and thereafter to engage said sliding means.

* * * * *